US012655785B2

(12) United States Patent
Chandrasekaran et al.

(10) Patent No.: US 12,655,785 B2
(45) Date of Patent: Jun. 16, 2026

(54) COOLING SYSTEM AND METHOD

(71) Applicant: Transportation IP Holdings, LLC, Norwalk, CT (US)

(72) Inventors: Shankar Chandrasekaran, Erie, PA (US); Munishwar Ahuja, Bangaluru (IN); James Schreiner, Erie, PA (US); Jason Quigley, Erie, PA (US); Brian Kott, Cumberland, MD (US); Michael Anthony, Erie, PA (US); Timothy Mientkiewicz, Erie, PA (US); Matt Gaydos, Jacksonville, FL (US)

(73) Assignee: Transportation IP Holdings, LLC, Norwalk, CT (US)

( * ) Notice: Subject to any disclaimer, the term of this patent is extended or adjusted under 35 U.S.C. 154(b) by 172 days.

(21) Appl. No.: 18/066,851

(22) Filed: Dec. 15, 2022

(65) Prior Publication Data

US 2023/0193809 A1 Jun. 22, 2023

Related U.S. Application Data

(60) Provisional application No. 63/290,541, filed on Dec. 16, 2021.

(51) Int. Cl.
*F01P 11/18* (2006.01)
*F01P 7/14* (2006.01)

(52) U.S. Cl.
CPC ..... *F01P 11/18* (2013.01); *F01P 7/14* (2013.01); *F01P 2007/146* (2013.01); *F01P 2025/70* (2013.01); *F01P 2050/22* (2013.01)

(58) Field of Classification Search
CPC ..... F01P 11/18; F01P 7/14; F01P 2007/146; F01P 2025/70; F01P 2050/22
USPC ..... 123/41.15
See application file for complete search history.

(56) References Cited

U.S. PATENT DOCUMENTS 9,499,422 B1 * 11/2016 Carson ..... C02F 1/72
2016/0186647 A1 * 6/2016 Styron ..... F01P 11/029 123/41.02
2018/0086292 A1 * 3/2018 Petrak ..... B60K 31/00

FOREIGN PATENT DOCUMENTS

KR 200347284 Y1 * 4/2004

* cited by examiner

*Primary Examiner* — Lindsay M Low
*Assistant Examiner* — Omar Morales
(74) *Attorney, Agent, or Firm* — K&L Gates LLP

(57) ABSTRACT

A cooling system includes a coolant tank, a coolant sensor assembly, and a controller. The coolant sensor assembly includes a sensor package having a first end and a second end, the sensor package including a partially transparent or semi-transparent sight glass housing a coolant level sensor and configured to receive a flow of coolant therethrough. The coolant sensor assembly also includes a first valve coupled between the first end of the sensor package and a coolant tank, a second valve coupled between the second end of the sensor package and the coolant tank, and a third valve coupled in flow communication with the second end of the sensor package. The controller is configured to execute one more diagnostic self-tests for the coolant sensor assembly and the cooling system.

19 Claims, 17 Drawing Sheets

COOLING SYSTEM AND METHOD

CROSS-REFERENCE TO RELATED APPLICATIONS

This application claims the benefit of priority to U.S. Provisional Patent Application No. 63/290,541, filed on Dec. 16, 2021, which is hereby incorporated by reference herein.

BACKGROUND

Technical Field

The subject matter described herein relates generally to cooling systems and, more particularly, to cooling systems, including diagnostic self-tests to identify one or more failure modes.

Discussion of Art

Vehicle cooling systems may experience one or more failure modes, such as leaks, coolant overfill or underfill, system clogs, and the like. In some instances, coolant level sensors are employed to detect some of these system-wide failure modes. However, it is also known that coolant level sensors may also experience one or more failure modes. For instance, for float-type coolant level sensors, failure modes may include a stuck or broken float. Other failure modes include broken switches, debris accumulation, valve malfunction, and the like. These failure modes can render the sensors ineffective or even inoperable.

In conventional cooling systems, failures are identified either (a) when the system fails, or (b) during frequent, time-intensive, and laborious manual system checks. These manual checks result in significant vehicle downtime, and may not be effective in identifying a source of a system or sensor failure. Moreover, certain tests, such as compression/squeeze tests, can add stress to the cooling system, which can in turn reduce the operational lifetime of the system. Additionally, at least some known coolant level sensors are configured or installed in a manner that makes the sensors difficult to inspect and may require significant dismantling of one or more components of the cooling system to inspect, repair, or replace.

BRIEF DESCRIPTION

In one or more embodiments, a coolant sensor assembly includes a sensor package having a first end and a second end, a first valve coupled between the first end of the sensor package and a coolant tank, a second valve coupled between the second end of the sensor package and the coolant tank, and a third valve coupled in flow communication with the second end of the sensor package. The sensor package includes a transparent, semi-transparent or opaque sight glass housing a coolant level sensor and configured to receive a flow of coolant therethrough.

In one or more embodiments, a cooling system of a vehicle includes a coolant tank, a coolant sensor assembly in flow communication with the coolant tank, and a controller configured to execute a diagnostic test (e.g. self-test) of the cooling system by: (a) cycling the cooling system through a plurality of operating modes; and (b) in each operating mode of the plurality of operating modes: (i) recording first sensor data output from the coolant sensor assembly to detect a level of coolant in the coolant tank; (ii) isolating the coolant sensor assembly from the coolant tank; (iii) recording second sensor data output from the coolant sensor assembly as the coolant is drained from the coolant sensor assembly; and (iv) analyzing the recorded first and second sensor data to identify or determine whether the cooling system is experiencing one or more failure modes.

In one or more embodiments, a method of diagnosing a cooling system of a vehicle includes (a) recording, by a controller, first sensor data output from a coolant sensor assembly in flow communication with a coolant tank of the cooling system, to detect a level of coolant in the coolant tank; (b) isolating the coolant sensor assembly from the coolant tank; (c) recording, by the controller, second sensor data output from the coolant sensor assembly as the coolant is drained from the sensor assembly; and (d) analyzing, by the controller, the recorded first and second sensor data to identify or determine whether the cooling system is experiencing one or more failure modes.

BRIEF DESCRIPTION OF THE DRAWINGS

The inventive subject matter may be understood from reading the following description of non-limiting embodiments, with reference to the attached drawings, wherein below.

DETAILED DESCRIPTION

Figure 1:
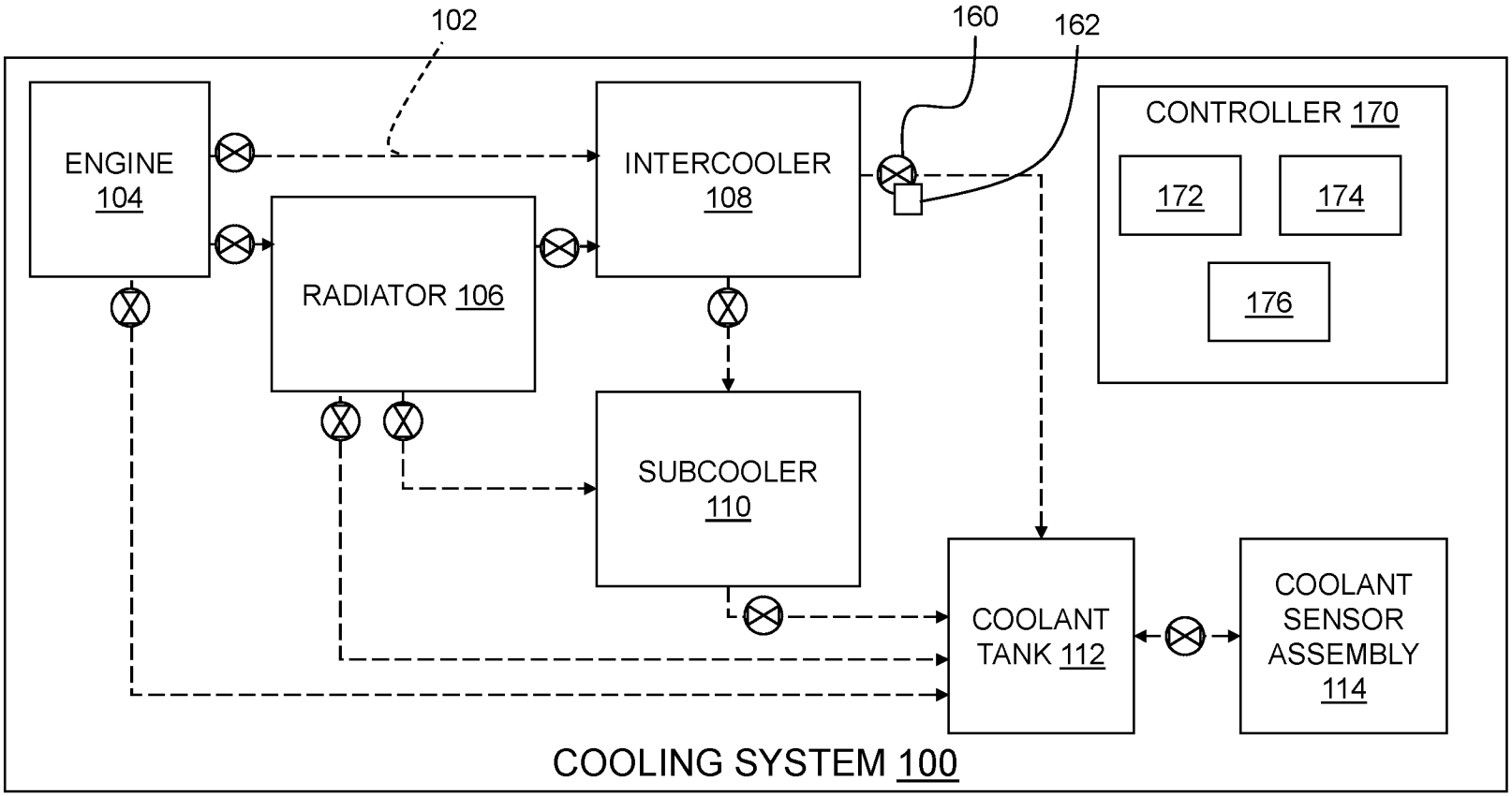
FIG. 1 illustrates a simplified schematic diagram of a vehicle cooling system.

Embodiments of the subject matter described herein relate to vehicle cooling systems.

As described herein, vehicle cooling systems are essential for the reliable functioning of a vehicle engine (or other propulsion system). However, it is recognized there are various ways that a cooling system can fail, in particular, lose coolant, which degrades the performance of the engine over some period of time.

Accordingly, various coolant diagnostic systems have been contemplated and implemented, for identifying issues in a vehicle cooling system before the issue leads to significant performance degradation or even system failure. For instance, coolant level sensors have been implemented to monitor a level of coolant within the cooling system (and/or other significant parameters of the coolant, such as temperature, flow, and the like). If the coolant level drops below a threshold value, a potential leak is identified.

However, as discussed above, such coolant sensors have various failure modes themselves, which can lead to incorrect readings and reduced efficacy of such sensors in detecting leaks or other cooling system issues. Embodiments of the present disclosure are directed to improved coolant sensor assemblies that may reduce or eliminate one or more of the above-described disadvantages of known coolant sensors. Moreover, embodiments of the coolant sensor assemblies may include self-diagnostic functionality that enables additional assessment of the cooling system and/or the coolant sensor assembly itself. Even further, embodiments of the present disclosure may be directed to cooling systems that employ the coolant sensor assemblies as part of a larger system of assessment and diagnostics, to improve predictive failure identification and, thereby, preventative failure mitigation.

Embodiments of the present disclosure include, therefore, a coolant sensor assembly designed to mitigate or eliminate the above-described disadvantages of known coolant sensors, as well as to execute diagnostic self-tests to identify one or more failure modes experienced by the coolant sensor assembly. The coolant sensor assembly is coupled in flow communication with a coolant tank, and broadly includes a coolant level sensor, which may be embodied as a float sensor or any other suitable coolant level sensor, enclosed in a transparent, semi-transparent or opaque sight glass. The coolant sensor assembly may include one or more additional sensors. As described further herein, the additional sensors may be arranged in a tube parallel to the sight glass or may be positioned within the sight glass (e.g., coupled to an inner wall of the sight glass).

In operation, embodiments of the coolant sensor assembly execute a diagnostic test (e.g. self-test) by isolating the sight glass from the coolant tank (e.g., by actuating one or more valves) and draining the coolant from the sight glass. Sensor data output from the coolant level sensor, as well the additional sensor(s)(if present), is recorded and analyzed to identify any applicable failure mode(s) of the coolant sensor assembly and/or the cooling system overall. Failure modes of the coolant sensor assembly may include, for example and without limitation, mechanical failure, electrical failure, misaligned ports, poor coolant quality, sensor failure, and/or operational failure.

In the example embodiment, this diagnostic test is executed at least in part by a controller communicatively coupled to the coolant sensor assembly. As described further herein, the controller may be local to (e.g., physically coupled to) the coolant sensor assembly, or may be remote therefrom (e.g. a vehicle controller that controls multiple operations of a vehicle).

Additionally, the coolant sensor assembly of the present disclosure includes mechanical advantages over known coolant sensors, including the transparent, semi-transparent or opaque sight glass, which enables visual monitoring/diagnostics and/or remote diagnostics using specific signatures unique to the failure modes of the coolant sensor, as well as an improved connection system that enables more efficient removal of the coolant sensor assembly from the cooling system, for cleaning, repair, replacement, and the like.

Embodiments of a cooling system including the coolant sensor assembly are also described in further detail herein. The cooling system may leverage the diagnostic test, (e.g. self-test) executed in or for the coolant sensor assembly as well as additional sensor data to identify system-level failure modes, including leakage rates and locations, as well as overfilling or underfilling of the system. Remedial actions, including maintenance, repair, or mission cancellation, or other vehicle control (e.g. slowing or stopping) may be identified, proposed and/or executed based on the outcome of the diagnostic testing.

Turning now to the figures, FIG. 1 is a simplified schematic diagram of a cooling system 100 in accordance with an embodiment of the present disclosure. In the example embodiment, the cooling system 100 is a vehicle cooling system. As used herein, "vehicle" refers generally to any vehicle, including a locomotive, an automobile, an aircraft, a marine vessel, and the like. The diagram of the cooling system 100 broadly illustrates the downstream flow of coolant 102, depicted as dashed arrows, from an engine 104 through one or more of a radiator 106, an intercooler 108, a subcooler 110, and a coolant tank 112. The coolant tank acts as a reservoir for a supply of the coolant, e.g., it holds a reserve of coolant in addition to the coolant flowing through the engine, etc. The cooling system will typically also include elements such as a coolant pump that is configured to pump relatively cool coolant from the coolant tank to the engine, etc. A coolant sensor assembly 114 is coupled in flow communication with the coolant tank 112. It should be readily understood that the depicted flow of coolant 102 is only one section of a closed loop cooling system 100 that facilitates continuous cooling of the engine 104.

Figure 2:
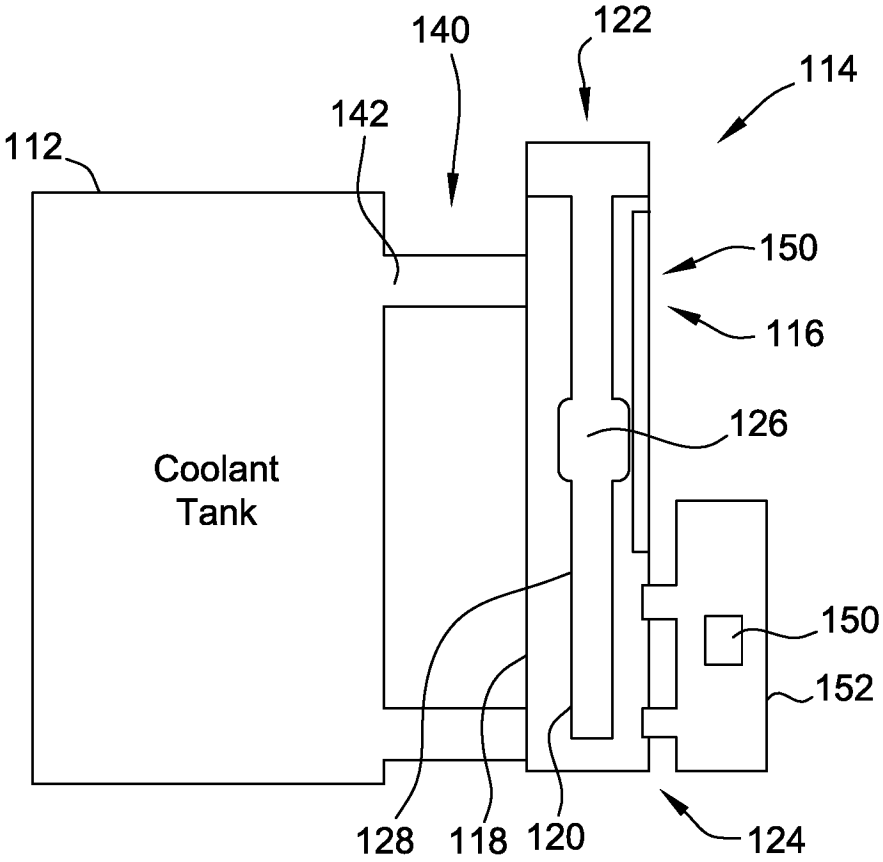
FIG. 2 illustrates a simplified schematic diagram of a coolant sensor assembly for use with the cooling system shown in FIG. 1.
Figure 3:
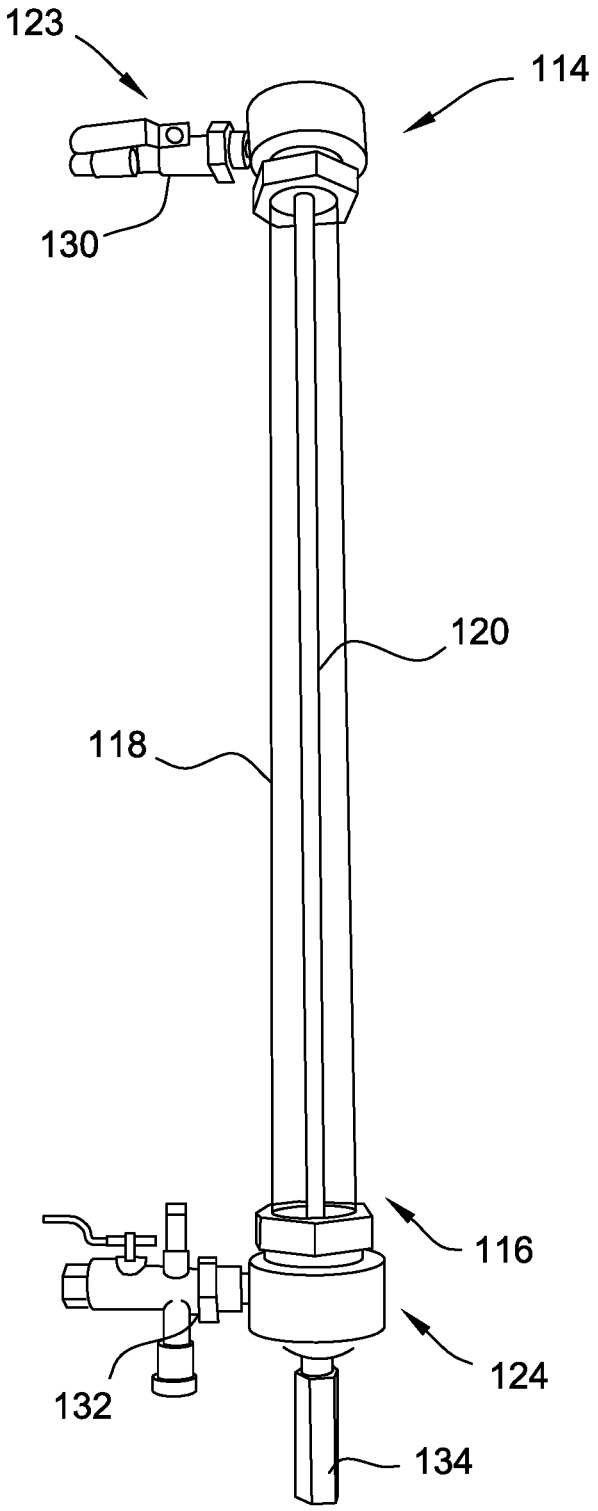
FIG. 3 illustrates a side elevation view of the coolant sensor assembly.
Figure 4:
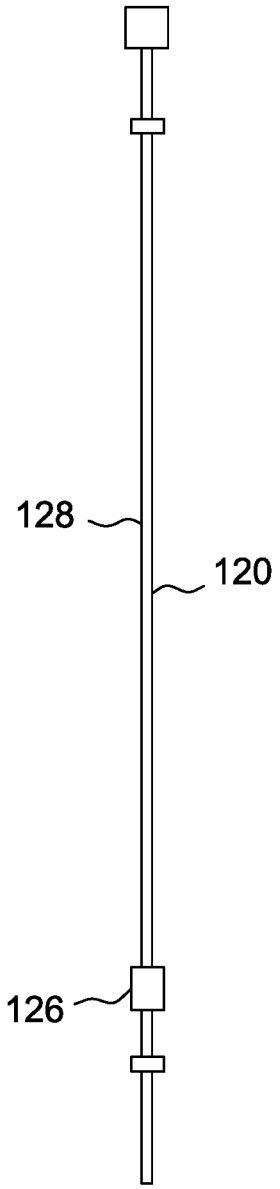
FIGS. 4 and 5 are side elevation views of a sight glass and coolant level sensor for use with the coolant sensor assembly.
Figure 5:
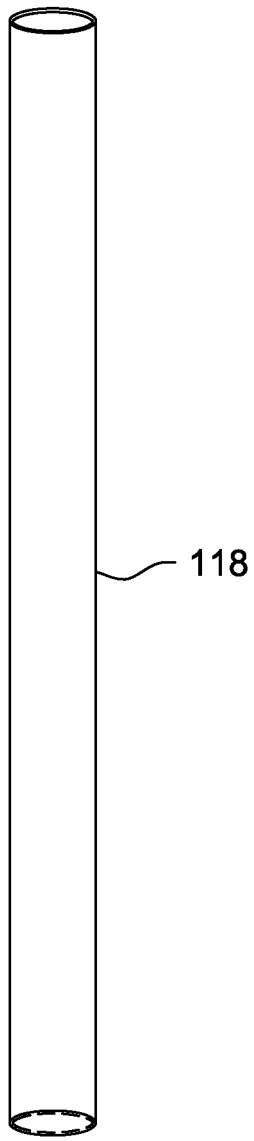

FIGS. 2 and 3 depict embodiments of the coolant sensor assembly 114 in greater detail. The coolant sensor assembly 114 may be implemented in any cooling system, including the vehicle cooling system 100. The coolant sensor assembly 114 includes a sensor package 116, which includes a sight glass 118 housing a coolant level sensor 120 (see also FIGS. 4 and 5).

The sensor package 116 has a first or top end 122 and a second or bottom end 124 of the sensor package 116. In embodiments, at least a portion of the sight glass 118 extends from a first or top end, corresponding generally to the top end 122 of the sensor package 116, to a second or bottom end, corresponding generally to the bottom end 124 of the sensor package 116. The sight glass 118 is transparent or semi-transparent, to enable visual inspection of the coolant level sensor 120 therein. For instance, the sight glass 118 may be formed from a polymeric (e.g., plastic) material, or from glass. In some embodiments, the sight glass 118 is partially transparent/semi-transparent, in that the sight glass 118 may be formed from an opaque metallic material, such as steel, but include one or more windows (e.g., of a polymer or glass) for visibility. Therefore, when the sight glass is formed of an opaque material, a suitable transparent or semitransparent opening is provided in the sight glass to enable visual inspection of the coolant sensor level. In the example embodiment, the sight glass 118 is chemically inert to the coolant 102, as well as any additives thereof, and is capable of withstanding high temperatures, such as up to about 140° C. The sight glass 118 may be further encapsulated—on the interior or exterior thereof—with a film (e.g., a plastic or other polymeric film), a heat reflective sheet, and/or a guard material, to implement or enhance any feature or function of the sight glass 118, as well as to provide protection (e.g., thermal protection, shatter protection) to the sight glass 118.

In embodiments, the sight glass is made of glass or a transparent polymer and the entirety of the sight glass is transparent. In other embodiments, at least a portion of the sight glass is at least semi-transparent, meaning semi-transparent or transparent, with the sight glass possibly including opaque portions. However, in other embodiments, the entirety of the sight glass is opaque. An opaque sight tube may be used in instances where the sight tube is not readily visible when installed, or based on the nature of the coolant (plus additives), or if other portions of the coolant sensor assembly are transparent or semi-transparent, e.g., parallel sensor tubes for housing additional sensors, as described elsewhere herein. Thus, the term "sight glass" generally refers to an elongate, hollow tube or other elongate, hollow structure, and does not necessarily require that the sight glass be made of glass and/or is at least semi-transparent, unless otherwise specified herein.

In the example embodiment, the coolant level sensor 120 is coaxial with the sight glass 118 and also extends between the top end 122 and bottom end 124 of the sensor package 116. The coolant sensor assembly 114 is coupled in flow communication with the coolant tank 112, such that the sight glass 118 is at least partially filled with coolant 102, in correspondence with a level of coolant in the coolant tank (e.g., when all parts are operating as intended, a level of coolant in the sight glass will correspond, at least relatively or proportionally, to a level of coolant in the coolant tank, such that if the level of coolant in the coolant tank goes up the level of coolant in the sight glass increases correspondingly, and if the level of coolant in the coolant tank goes down the level of coolant in the sight glass decreases correspondingly). The coolant level sensor 120 is embodied in the example embodiment as a float sensor, which includes a float 126 circumscribing a stem 128. The stem 128 includes an electrical sensor, such as voltage sensor, having a plurality of switches (not illustrated) oriented along a vertical or longitudinal axis of the stem 128. The plurality of switches are arranged in a predetermined, regularly spaced pattern (e.g., every 0.25 inches along the length of the coolant level sensor 120). In normal operation, as the float 126 traverses the stem 128 (vertically downward), the float 126 opens the switches (e.g., via magnet), and a predictable voltage signal is output therefrom. The coolant level sensor 120 may alternatively be embodied as any other suitable coolant level sensor such as an ultrasound sensor or a capacitive sensor.

The coolant sensor assembly 114 also includes a first valve 130 coupled to the top end of the sight glass 118 and a second valve 132 coupled to the bottom end of the sight glass 118 (see FIG. 3). In one embodiment, the first and second valves 130, 132 are cutout valves, which are actuated between a first, open position and a second, closed position (as well as any intermediate position between the first and second positions, where suitable). When the first and second valves 130, 132 are in the open position, the sight glass 118 is in flow communication with the coolant tank 112. The cutout valves 130, 132 may be configured to be manually, electrically, electromechanically, and/or electro-pneumatically actuated from the open to the closed position to isolate the coolant sensor assembly 114—specifically, the sight glass 118—from the coolant tank 112 (e.g., during a diagnostic test, as described in detail herein), and to be manually, electrically, electromechanically, and/or electro-pneumatically actuated from the closed to the open position to re-fluidly connect the coolant sensor assembly 114 to the coolant tank. Additionally, a drain valve 134 is coupled in flow communication with the bottom end 124 of the sensor package 116. The drain valve 134 may be manually, electrically, electromechanically, and/or electro-pneumatically actuated to drain coolant 102 from the sight glass 118 (e.g., during the diagnostic test). In embodiments, the valves 130, 132, 134 are configured to be directly or indirectly electrically actuated, e.g., responsive to control signals received from a controller, to controllably transition between open (allowing fluid to pass) and closed (preventing fluid from passing) states. (Direct electric actuation includes, for example, electrically activating and deactivating a solenoid that opens/closes a valve member, or supplying electric power to a motor that opens/closes a valve member. Indirect electric actuation includes, for example, supplying electric power to a hydraulic pump that in turn pressurizes a hydraulic cylinder with hydraulic fluid that in turn opens/closes a valve member.)

A sensor-tank interface 140 (see FIG. 2), including a plurality of conduits 142, couples the coolant sensor assembly 114 to the coolant tank 112. In some embodiments, the conduits 142 are rigid, whereas in other embodiments, the conduits 142 are flexible. In some embodiments, the sensor-tank interface 140 includes one or more connections (not specifically illustrated) that facilitate connection of the conduits 142 to either the coolant tank 112 or the coolant sensor assembly 114, such as one or more swivel fittings. In the example embodiment, the connections are implemented such that the coolant sensor assembly 114 is removably coupled to the coolant tank 112 or the sensor-tank interface 140. In this way, the coolant sensor assembly 114 may be more efficiently removed for cleaning, inspection, maintenance, repair, and/or replacement. The connections may be integral to the first and second valves 130, 132, in some embodiments, such that the valves 130, 132 facilitate a flexible connection between the coolant sensor assembly 114 and the sensor-tank interface 140. In some embodiments, the coolant sensor assembly 114, or the sensor-tank interface 140, includes one or more filter components (not shown), to filter large particles from the coolant 102 as the coolant 102 flows from the coolant tank 112 to the coolant sensor assembly 114, which may enhance operation of the coolant sensor assembly 114.

As depicted in FIG. 2, in embodiments, the coolant sensor assembly 114 may also include one more additional sensors 150. In some embodiments, these additional sensors 150 are arranged in a secondary tube 152 that is parallel to and coupled in flow communication with the sight glass 118. Additionally or alternatively, the additional sensors 150 are positioned within the sight glass 118 (e.g., coupled to an interior wall of the sight glass 118, at one or more locations). That is, one or more additional sensors 150 (e.g., a first subset of the additional sensors 150) may be positioned within the secondary tube 152, and one or more other additional sensors 150 (e.g., a second subset of the additional sensors 150) may be positioned within the sight glass 118. In some instances, the sensor(s) 150 in the secondary tube 152 may be different types of sensors than the sensor(s) 150 in the sight glass 118; in other instances, the sensor(s) 150 in the secondary tube and in the sight glass 118 include the same or similar sensors 150 (e.g., for redundancy). It is further contemplated that additional sensor(s) 150 may be integral with or built into the sight glass 118 itself, and/or into the secondary tube 152.

The additional sensors 150 include any suitable sensor types that may be implemented for failure mode detection. In the example embodiment, the additional sensors 150 include pH sensor(s), to measure alkalinity of the coolant; corrosion sensor(s), to measure rust accumulation; capacitive sensor(s), to measure total dissolved solids (TDS); ultrasound sensors to use signal transmission to measure particulate matter in the coolant; and/or any combination thereof.

In the example embodiment, the coolant sensor assembly 114 is located outside of the coolant tank 112, which may enable more efficient inspection, operation, removal, and/or replacement thereof. However, in one or more alterative embodiments, the coolant sensor assembly 114 is positioned within the coolant tank 112.

Figure 6:
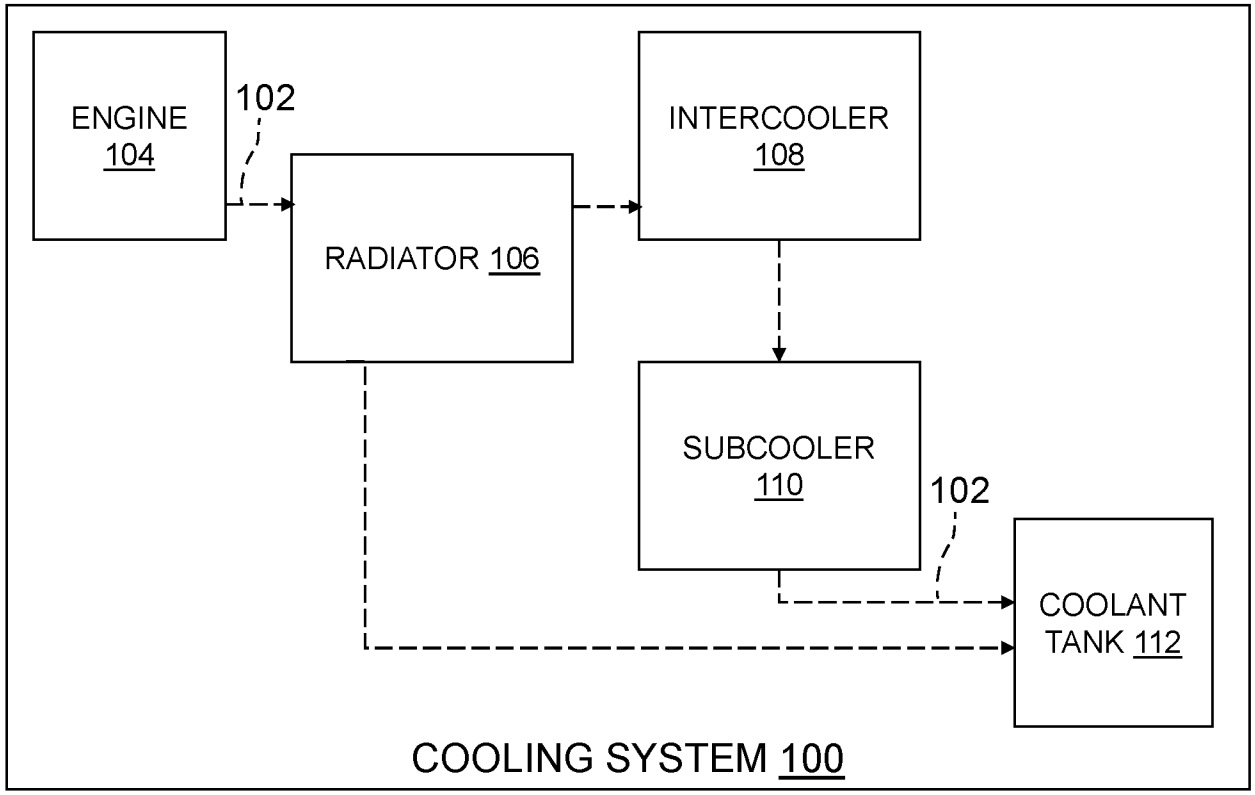
FIGS. 6-8 illustrate simplified schematic diagrams of various operating modes of the cooling system shown in FIG. 1.
Figure 7:
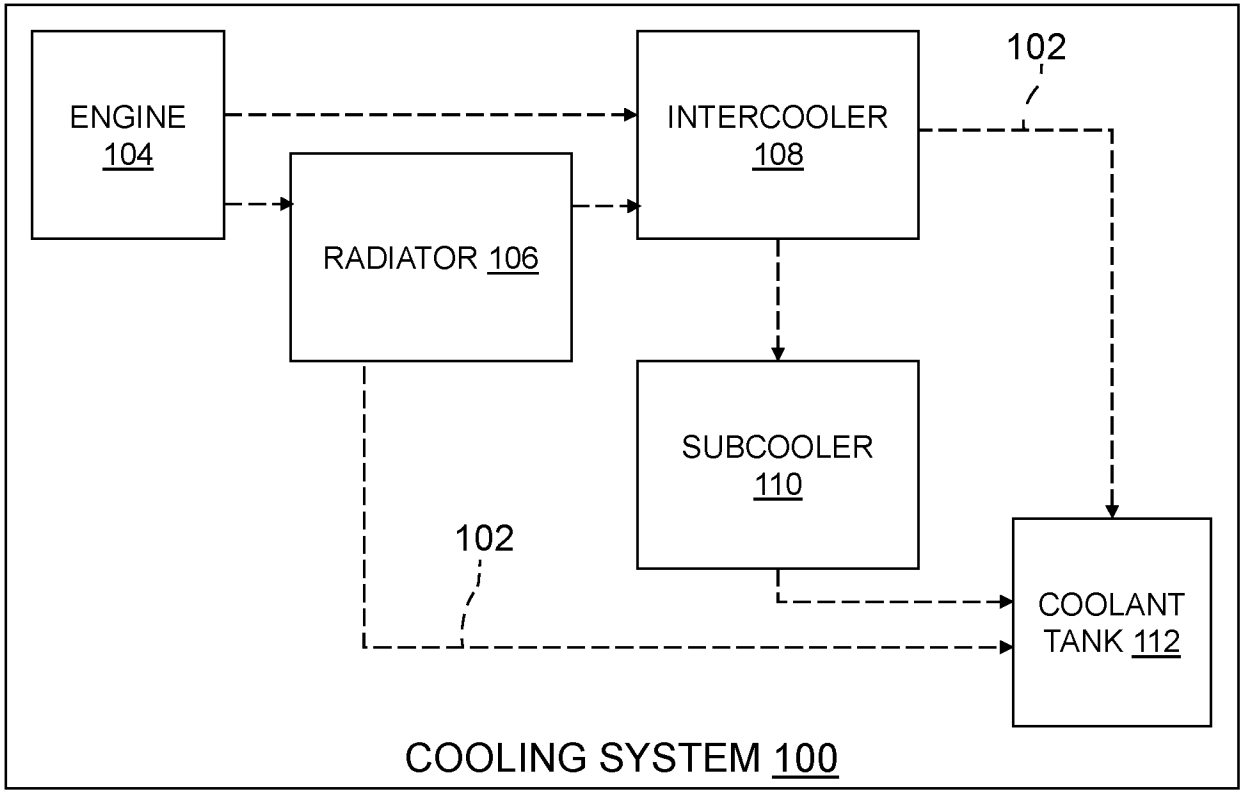
Figure 8:
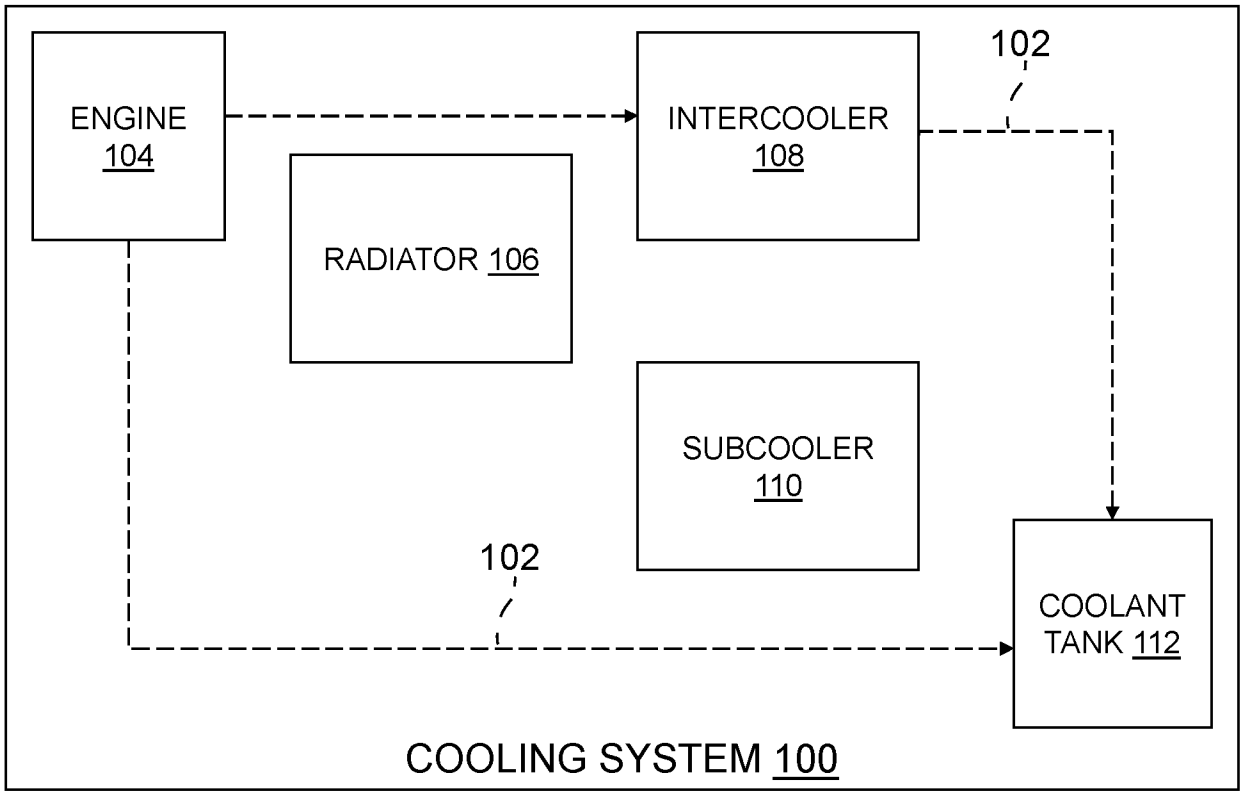

Turning to FIGS. 6-8, operation of embodiments of the cooling system 100 in a plurality of operating modes is schematically depicted. During high ambient temperatures and under high loads, the cooling system 100 operates in a first mode (Mode 1, see FIG. 6). In Mode 1, the coolant 102 flows downstream from the engine 104 and through the radiator 106, intercooler 108, and subcooler 110 to the coolant tank 112. During lower ambient temperatures and under low loads, the cooling system 100 operates in a second mode (Mode 2, see FIG. 7). In Mode 2, the coolant 102 flows downstream from the engine 104 in a split path. Part of the coolant 102 flows through the radiator 106 and the subcooler 110 to the coolant tank 112, and part of the coolant 102 flows directly through the intercooler 108 to the coolant tank 112. When no cooling is required, the cooling system 100 operates in a third mode (Mode 3, see FIG. 8). In Mode 3, the coolant flows downstream from the engine 104 in a split path. Part of the coolant 102 (e.g., about ⅔ of the coolant 102) flows directly to the coolant tank 112, and part of the coolant 102 (e.g., about ⅓ of the coolant 102) flows through the intercooler 108. Notably, in Mode 3, no coolant flows through the radiator 106 or the subcooler 110.

The cooling system 100 includes a plurality of valves 160 (see FIG. 1) that are independently actuatable between respective open and closed positions, to transition the cooling system 100 from one mode to another. One or more of these valves 160 may include valve sensor(s) 162 therein, which output sensor data that reflects operation of the respective valve 160 (e.g., flow sensors, current sensors switch on/off sensors, and the like).

In one example embodiment, the cooling system 100 also includes a controller 170 (see FIG. 1). The controller 170 is configured to actuate one or more components of the cooling system 100 and to receive sensor data output from cooling system sensors, including the coolant sensor assembly 114. The controller 170 may be local to the coolant sensor assembly 114, such that coolant sensor assembly 114 itself includes the local controller 170. Alternatively, the controller 170 is remote from the coolant sensor assembly 114 and is coupled in wired and/or wireless communication with one or more components of the cooling system 100 and/or coolant sensor assembly 114. For example, the controller 170 may be located within an operator cabin of the vehicle, or within an operator cabin of a facility in which the vehicle is positioned. Moreover, the controller 170 may be embodied as a single controller or computing device, or the functions of the controller 170 described herein may be implemented across two or more interconnected controllers or computing devices.

The controller 170 includes at least one processor 172 for executing instructions. In some embodiments, executable instructions are stored in a memory 174. In some embodiments, the processor 172 includes one or more processing units (e.g., in a multi-core configuration). The memory 174 is any device allowing information such as executable instructions and/or other data to be stored and retrieved. Specifically, in some embodiments, the memory 174 includes, but is not limited to, random access memory (RAM) such as dynamic RAM (DRAM) or static RAM (SRAM), read-only memory (ROM), erasable programmable read-only memory (EPROM), electrically erasable programmable read-only memory (EEPROM), and non-volatile RAM (NVRAM). The above memory types are exemplary only, and are thus not limiting as to the types of memory usable for storage of a computer program and/or data.

In some embodiments, the controller 170 is coupled to any component of the cooling system 100 via a wired and/or a wireless connection. In some embodiments, the controller 170 is configured to facilitate activation and control of the cooling system 100 (e.g., automatic control of the cooling system 100) to perform system-wide or assembly-level diagnostic tests, according to stored or received controls. In some embodiments, the controller 170 initiates the test(s) in response to a request or command, such as from an operator or remote device. In other embodiments, the controller 170 initiates the diagnostic test(s) periodically, according to a stored schedule.

Accordingly, the controller 170 may include a communication interface 176, which is communicatively couplable to any component of the cooling system 100 described herein and/or to a remote device (e.g., an operator device) that transmits controls for controlling operation of the cooling system 100 and/or receiving outputs (e.g., instructions, directions, alerts, remedial actions, etc.). In some embodiments, the communication interface 176 includes, for example and without limitation, a wired or wireless network adapter or a wireless data transceiver adapted for communication over a radio link (e.g., narrowband or broadband radio links), a cellular or mobile data network (e.g., 3G, 4G, or 5G network technology), or a BLUETOOTH link.

The controller 170 may be configured to interpret data from any sensor or other component of the cooling system 100 in accordance with pre-programmed instructions. For example, the controller 170 may interpret sensor data to identify the nature and/or location of one or more failure modes of the cooling system 100. As used herein, the identification of "failure modes" may include the identification of any system malfunction, as well as any normal or properly functioning condition of the cooling system 100 or any component thereof. That is, the controller 170 may store data (e.g., sensor data signatures, learning algorithms, etc.) to identify any "normal" or "abnormal" functioning of the cooling system 100 or any component thereof.

Figure 9:
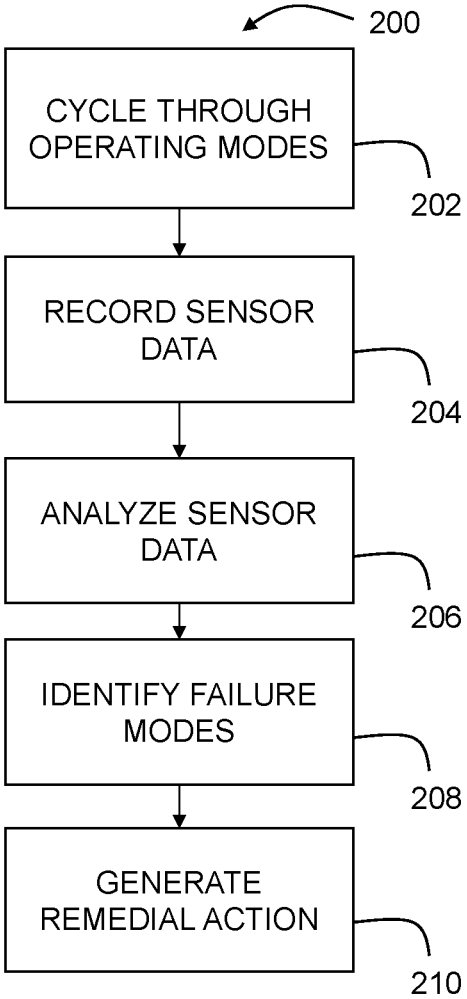
FIG. 9 is a simplified flow diagram of a method of executing a system-wide diagnostic self-test.

With reference to FIG. 9, the controller 170 is configured to initiate a system-wide diagnostic self-test, which is depicted with a simplified flow diagram 200. In the example embodiment, the system-wide diagnostic test is executed at least in part by the controller 170. In some embodiments, the controller 170 initiates the system-wide diagnostic test in response to a request or command, such as from an operator or remote device. The system-wide diagnostic test includes cycling 202 the cooling system 100 through each operating mode (e.g., Modes 1-3). The cycling 202 may include, for example, the controller 170 transmitting instructions to the plurality of valves 160 to actuate between their respective positions, to transition the cooling system 100 into each operating mode, and controlling the engine into particular operating modes or states of the engine.

The valve sensors 162 record 204 data during each transaction (e.g., to confirm suitable valve operation). In each operating mode, the coolant sensor assembly 114 and any valve sensors 162 record 204 sensor data. This sensor data is output to the controller 170. In some embodiments, the sensor data is output to the controller 170 substantially in real-time, such as within milliseconds or seconds of the sensor data being recorded at the respective sensor. In other embodiments, the sensor data is aggregated and output to the controller 170 at some later time, although still within seconds to minutes of each cycle 202.

The controller 170 analyzes 206 the sensor data, during or after receipt thereof. That is, in some cases, the controller 170 monitors and analyzes 206 the sensor data substantially concurrently with receipt of the sensor data; in other cases, the controller 170 receives and stores the sensor data and then subsequently performs analysis 206 of the entire sensor data set. In any embodiment, the controller 170 may store the received sensor data for any suitable length of time, for current or subsequent analysis thereof.

Moreover, the controller 170 may receive and store sensor data from periods of time other than during the diagnostic test(s). For example, cooling system sensors may record data during normal operation of the cooling system 100. The controller 170 may store this operational or "historical" sensor data and leverage the historical data in any of the analyses described herein (e.g., to track an identified leak over a period of time).

In the example embodiment, the controller 170 analyzes 206 the sensor data (e.g., including the recorded sensor data and, in some embodiments, the historical sensor data) by comparing the sensor data to stored signatures of known operational or failure modes that the coolant sensor assembly 114 or any other component(s) of the overall cooling system 100 may experience. For example and without limitation, the controller 170 stores, in the memory 174, the signature of operational switches, closed switches, open switches, missing or non-operational switches, power supply issues, operational float 126, stuck float 126, damaged or sunk float 126, leakage from the sight glass 118, leakage from another component of the cooling system 100, debris accumulation in the sight glass 118 or valves 130, 132, coolant alkalinity (representative of additive levels), coolant contamination, debris accumulation on the float 126, valve 130, 132, 160 malfunction, sensor package 116 misalignment, overheated coolant 102, overfilled coolant 102, and underfilled coolant 102. These signatures may be embodied as known sensor output from one or more of the coolant level sensor 120, valve sensor(s) 162, and/or additional sensor(s) 150, such as an electrical (e.g., voltage) signature or other characteristic of any collected sensor data. In some embodiments, the system-wide diagnostic test may also include a step of pressurizing the cooling system 100, which may accentuate the signatures of the known failure modes.

Figure 11:
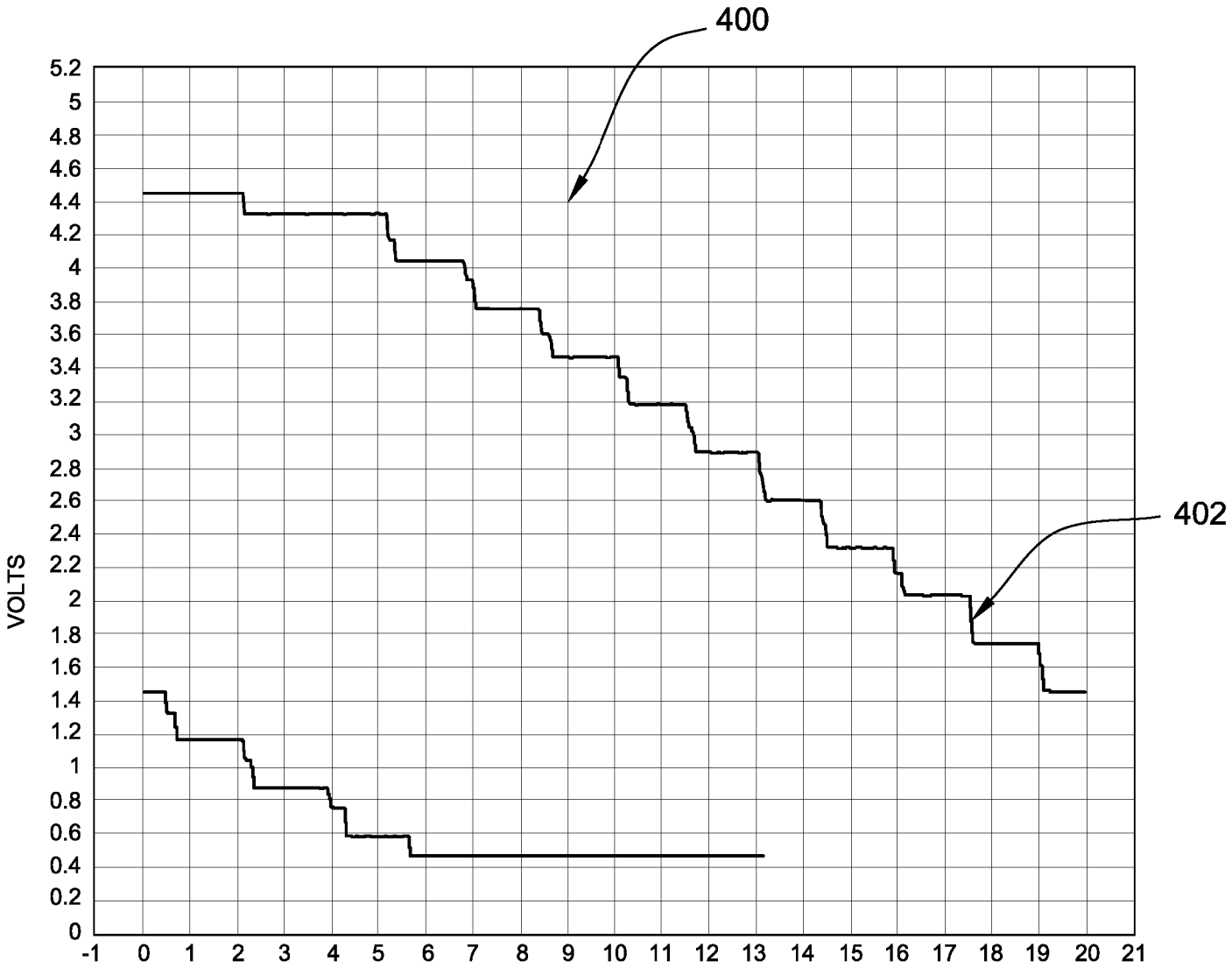
FIGS. 11-18 depict example sensor data signatures of failure modes that may be experienced by the cooling system.
Figure 12:
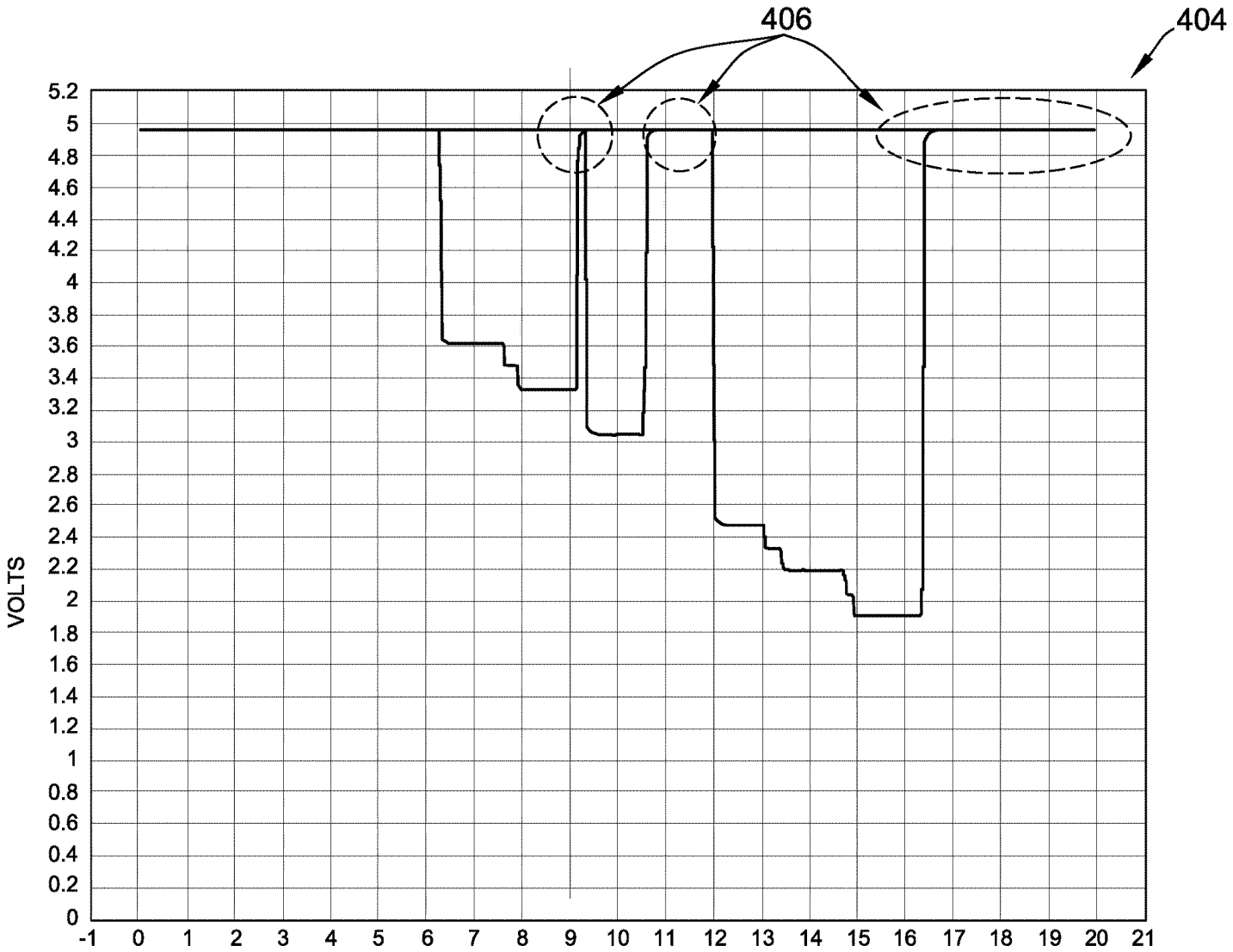
Figure 13:
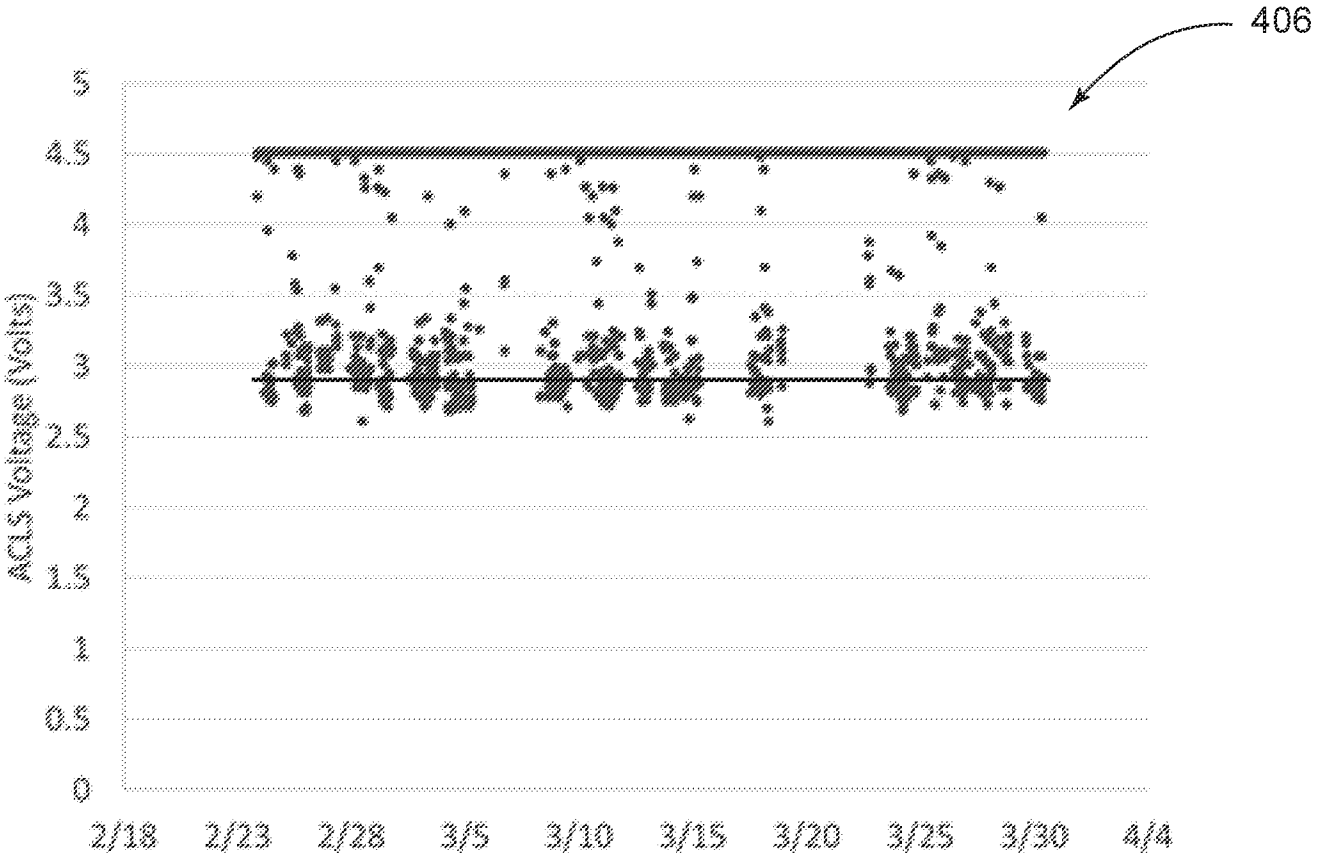
Figure 14:
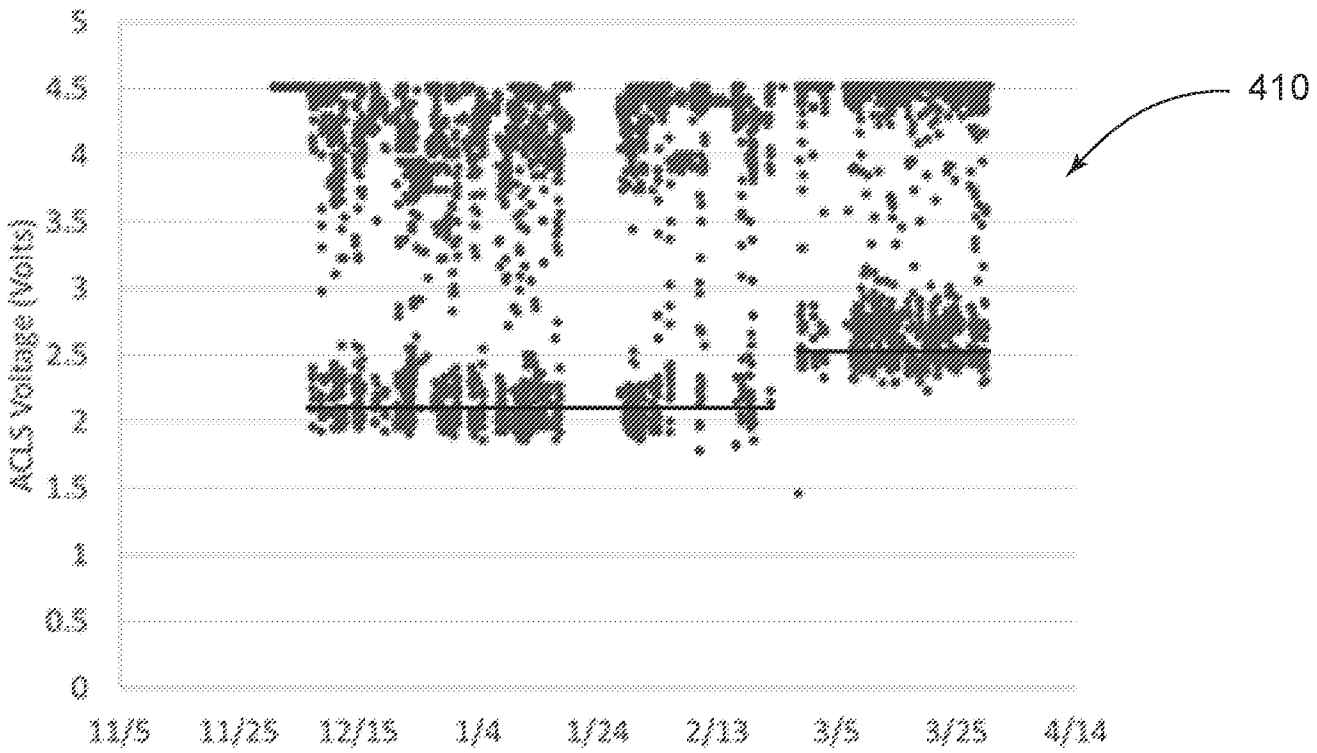
Figure 15:
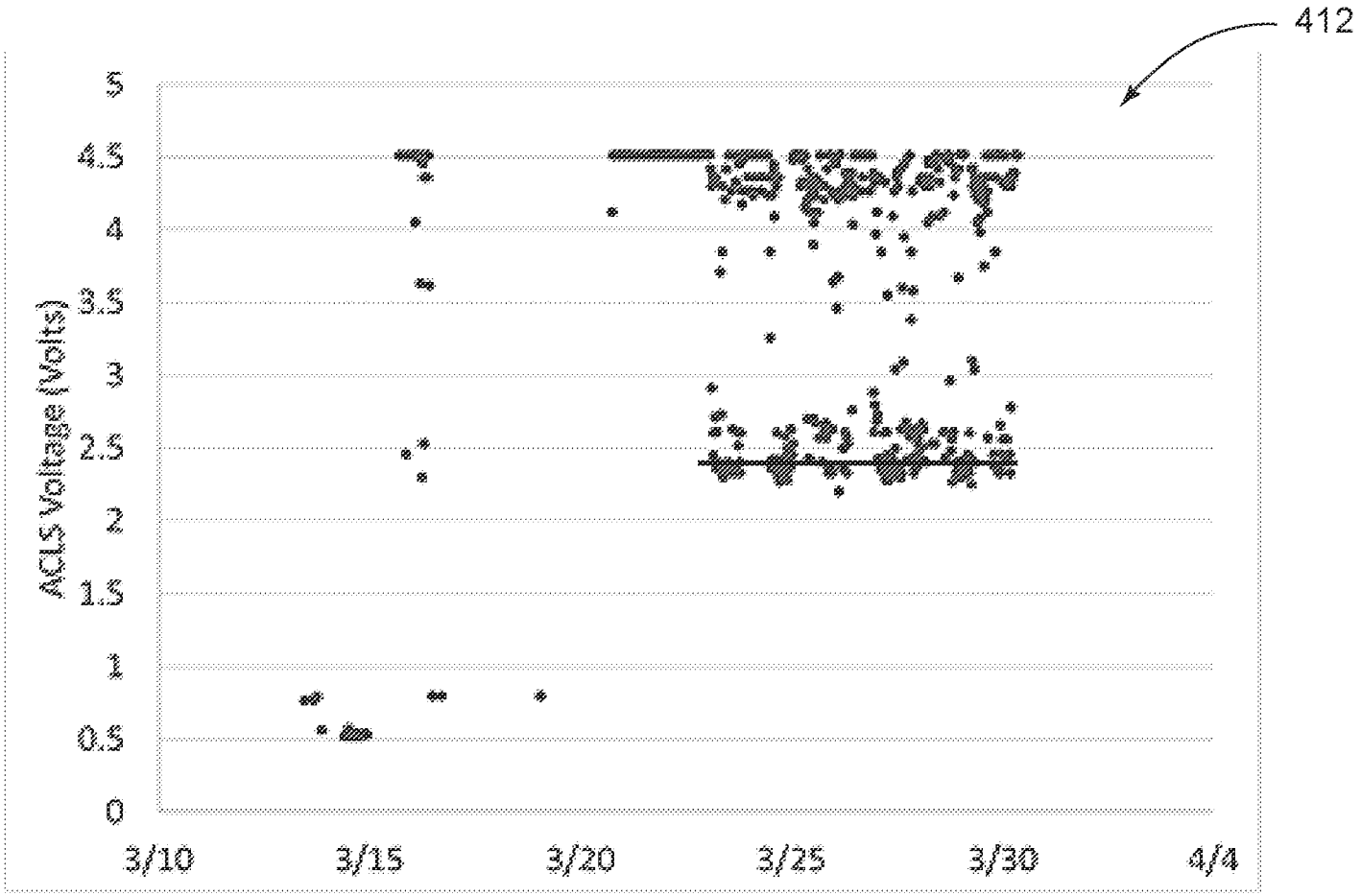

Various failure mode signatures are depicted in FIGS. 11-18. More specifically, FIG. 11 depicts example electrical output (or signature) 400 from the coolant level sensor 120 (e.g., from the switches thereof) illustrating a switch malfunction at a missing step 402. FIG. 12 depicts example electrical output (or signature) 404 from the coolant level sensor 120 illustrating intermittent open switches at 406. FIGS. 13, 14, and 15 depict signature outputs 408, 410, and 412, of an overfilled coolant tank 112, underfilled coolant tank 112, and correctly filled coolant tank 112, respectively.

Figure 16:
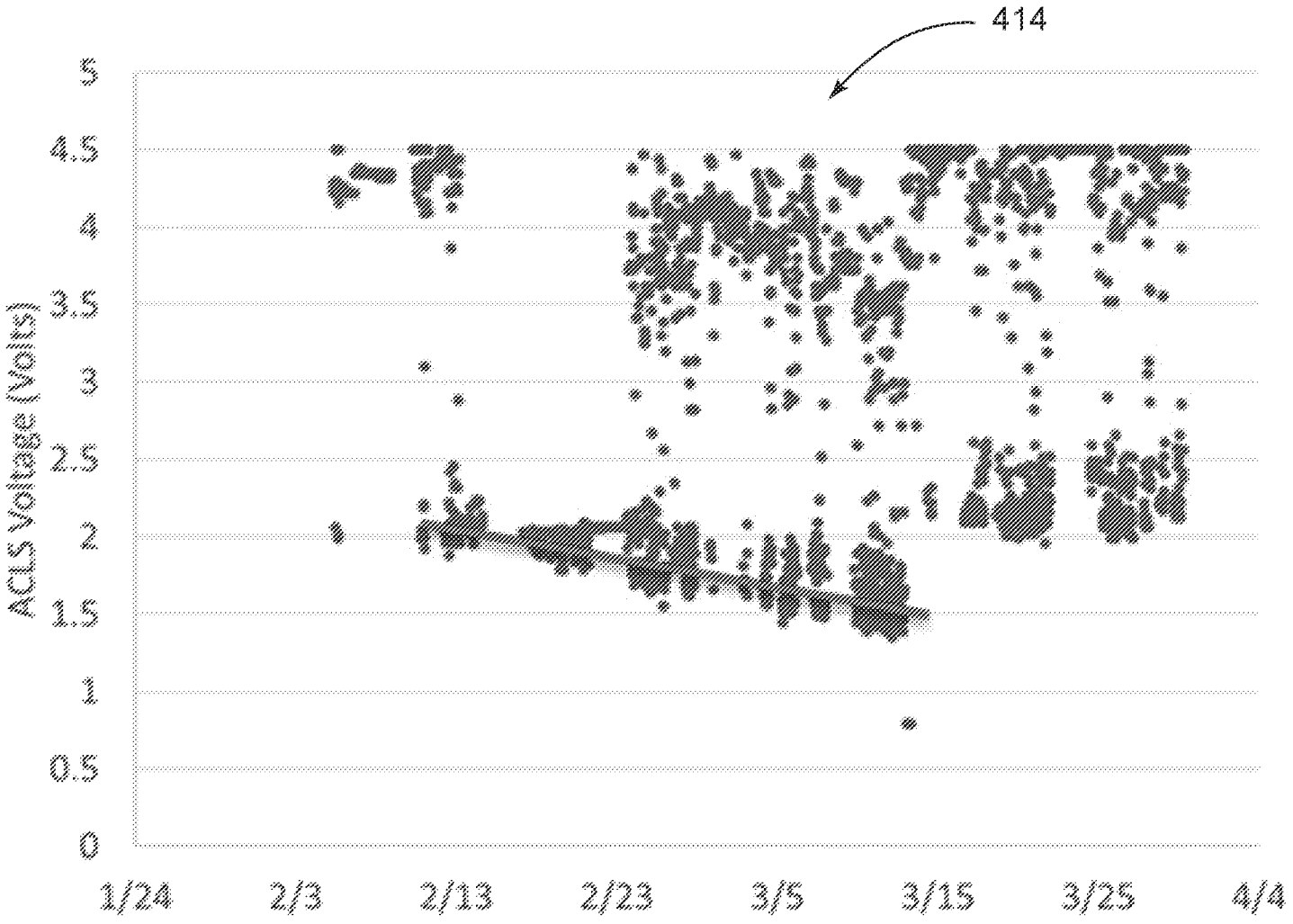
Figure 17:
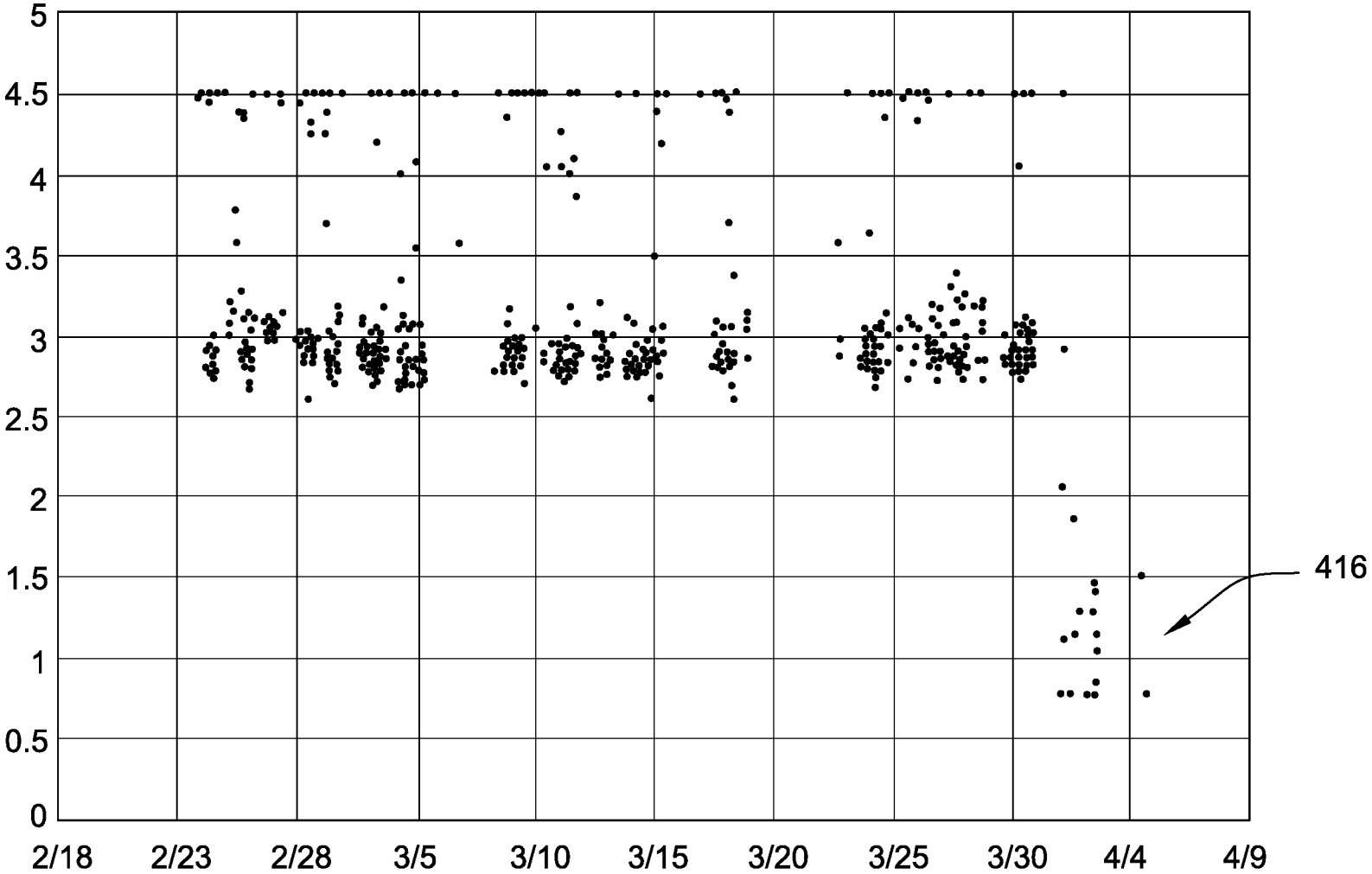
Figure 18:
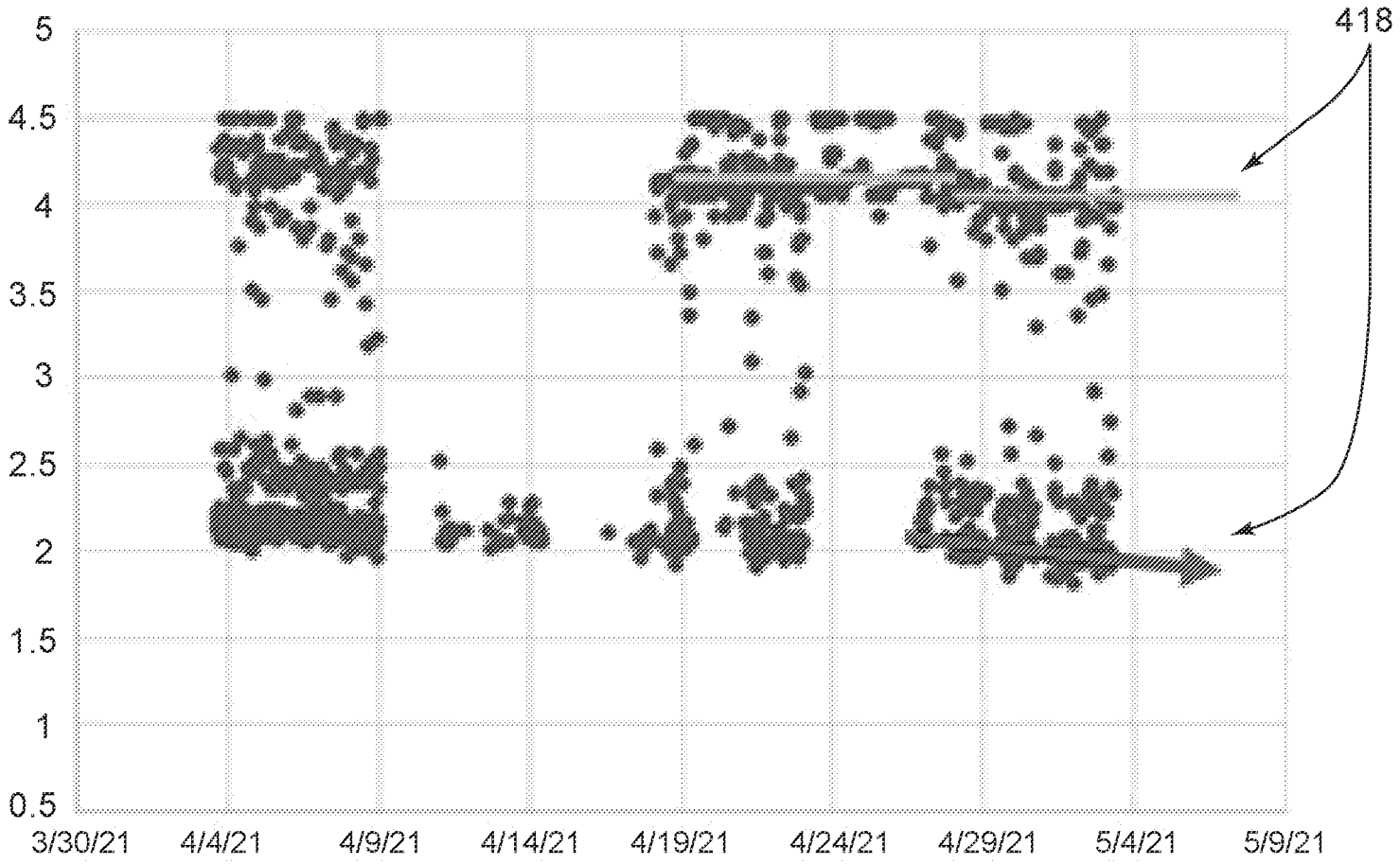

FIGS. 16 and 17 depict signature outputs 414, 416, respectively, of coolant loss at differing rates (e.g., slow, representative of a slow leak, as shown in FIG. 16; and abrupt, representative of a component failure, such as a broken radiator hose, as shown in FIG. 17). FIG. 18 depicts a signature output 418 of an intermittent leak, which can identify a leak in a particular component that is intermittently operational (e.g., in one operational mode of the cooling system 100 but not another).

In embodiments, the particular rate of loss of coolant within one operating mode, or common to all operating modes, is determined by the controller 170 and used to identify a location of a coolant leak based on when the coolant loss is detected (e.g., in which operating mode(s)) and the magnitude of the coolant loss. For example and without limitation, a moderate rate of coolant loss common across all operating modes may be reflective of a failure of a coolant pump (not shown); a drastic rate of coolant loss may represent a broken pipe, and the location may be identified using the signature of one or more valve sensors; a slow rate of coolant loss common across all operating modes may reflect internal leaks in the engine 104; a drastic rate of coolant loss in Mode 1 and Mode 3, but not in Mode 2, may be representative of a leak in the radiator 106 or a radiator hose; and a slow rate of coolant loss in Mode 1 and Mode 3, but not in Mode 2 (or less in Mode 2) may be representative of a leak in the intercooler 108.

By analyzing the sensor data, the controller 170 identifies 208 one or more failure modes experienced by the coolant sensor assembly 114 or of the cooling system 100 in which the coolant sensor assembly 114 is implemented.

In embodiments, the cycling 202 may also include initiating a diagnostic self-test in the coolant sensor assembly 114, during operation in one or more of the operating modes. Alternatively, the assembly diagnostic test may be executed independently of the system-wide diagnostic test. For example, in some instances, the controller 170 initiates the assembly diagnostic test periodically, in accordance with a stored schedule (e.g., every six months, twelve months, etc.). The stored schedule may be modified according to seasonal or ambient changes (e.g., to be initiated more frequently during the winter or in colder climates). In some instances, the controller 170 initiates the assembly diagnostic test after a positive outcome from the system-wide diagnostic test. In still other instances, the controller 170 initiates the assembly diagnostic test in response to a request or command, such as from an operator or remote device. For example, an operator may request initiation of the assembly diagnostic test prior to every vehicle mission.

Figure 10:
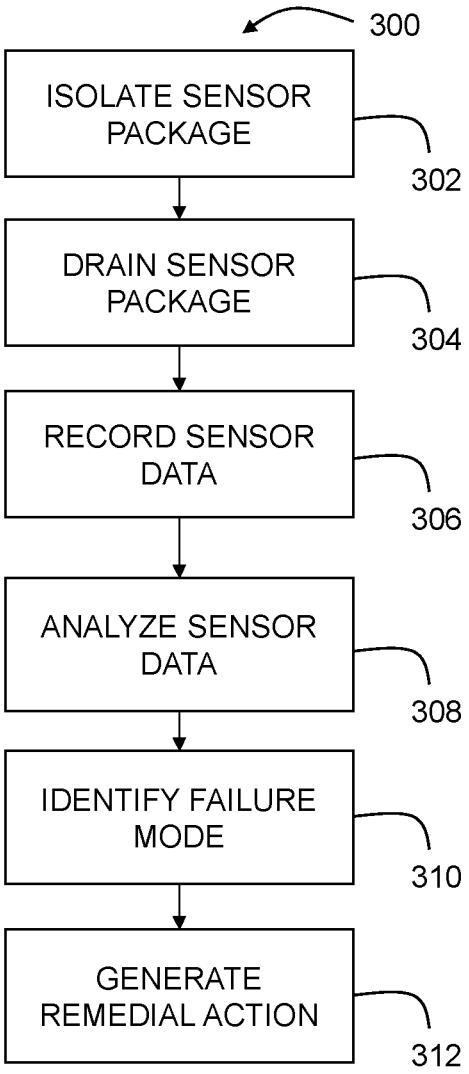
FIG. 10 is a simplified flow diagram of a method of executing an assembly diagnostic self-test.

Turning to FIG. 10, the assembly diagnostic test is depicted with a simplified flow diagram 300. In the example embodiment, the assembly diagnostic test includes isolating 302 the coolant sensor assembly 114 from the coolant tank 112. The isolating 302 may include specifically isolating 302 the sensor package 116, or the sight glass 118 in particular, from the coolant tank 112. The isolating 302 includes actuating the first and second valves 130, 132 from their respective open positions to their respective closed positions. Where the first and second valves 130,132 are remotely actuatable (e.g., may be electro-mechanically or electro-pneumatically actuated), the controller 170 may transmit signals to each of the first and second valves 130, 132, where the signals cause actuation of the first and second valves 130, 132 to the closed positions. Where the first and second valves 130, 132 are manually actuatable, the controller 170 may transmit instructions to an operator device communicatively coupled to the controller 170, wherein the instructions cause the operator device to display (e.g., on a user interface thereof) directions to a human operator to manually actuate the first and second valves 130, 132 to the closed positions.

In an embodiment, the diagnostic test includes, once the coolant sensor assembly is isolated from the coolant tank by closing the valves 130, 132 (and with the drain valve remaining closed), receiving sensor data output by the sensor(s) of the coolant sensor assembly, and comparing the received sensor data to one or more designated criteria that are indicative of potential faults in the coolant sensor assembly. For example, once the assembly is isolated, the level of coolant in the sight glass should remain the same, unless there is a leak in the assembly. Thus, if the received sensor signals show a steady coolant level, the system may determine that the assembly is not leaking. However, if the received sensor signals show a decreasing coolant level, the system may determine that the assembly is leaking and needs repair. Similarly, other than temperature, other characteristics of the coolant should not change significantly when the assembly is isolated, at least not within a relatively short time period. Thus, if within a designated, relatively short time period the sensor output of any of the additional sensors changes (e.g. by more than a designated threshold, depending on sensor type), this may be indicative of a leak and/or sensor failure.

In another embodiment, isolating the coolant sensor assembly without draining may be used as an alternative or additional way to sense leaks in the coolant tank or other parts of the coolant system. For example, the coolant sensor assembly may be isolated, and then checked for leaks as per above. If the coolant sensor assembly is deemed as not leaking (e.g., all sensor outputs are steady), a current level of coolant in the sight tube is sensed and recorded, and the coolant system is controlled to a steady state, e.g., engine turned off and coolant pump deactivated, plus waiting a designated time period for any coolant in the circuit to return to the tank. Subsequently, a designated waiting period is tracked while the coolant system remains in steady state and the coolant sensor assembly is isolated. The waiting period provides a time for coolant to exit the tank if there are leaks present, e.g., thirty minutes to one hour. After the waiting period, the coolant sensor assembly is re-fluidly connected to the coolant tank, and the subsequent coolant level in the sight tube is sensed and recorded for a designated time period (e.g., several seconds or more). If there are no leaks present in the coolant tank (or other relevant locations), the sensed subsequent coolant level in the sight tube should be approximately the same as the original recorded coolant level. On the other hand, if there are leaks present in the coolant tank, the sensed subsequent coolant level in the sight tube should be less than the original recorded coolant level, and exhibit a near step-like decrease. The step-like decrease may be easier for the controller to identify than a gradual decrease.

The assembly diagnostic test may further include draining 304 the sensor package 116 (e.g., the sight glass 118) of coolant 102. The draining 304 includes actuating the drain valve 134 to an open, drain position. Where the drain valve 134 is remotely actuatable (e.g., may be electro-mechanically or electro-pneumatically actuated), the controller 170 may transmit signals to the drain valve 134, where the signals cause actuation of the drain valve 134 to the open position. Where the drain valve 134 is manually actuatable, the controller 170 may transmit instructions to an operator device communicatively coupled to the controller, wherein the instructions cause the operator device to display (e.g., on the user interface thereof) directions to a human operator to manually actuate the drain valve 134 to the open position.

During the isolating 302 and the draining 304, the sensors, including the coolant level sensor 120 and any additional sensors 150, record 306 sensor data, which is analyzed 308 by the controller 170 as described above. Notably, the analyzing 308 of the sensor data recorded 306 during the assembly diagnostic self-test may be performed in parallel with or before/after the cycling 202 of the cooling system 100 in the system-wide diagnostic test. Moreover, in certain embodiments, the assembly diagnostic test is performed entirely independently of any system-wide diagnostic test.

In an embodiment, the diagnostic test may include the coolant level of coolant in the coolant sensor assembly (e.g., in the sight glass) being sensed by the coolant level sensor from a time period after the coolant sensor assembly is isolated from the coolant tank but before the coolant sensor assembly is drained, through to when drainage is completed (while the sensor assembly is isolated from the coolant tank). If the coolant level sensor is operating normally, draining the coolant from the isolated coolant sensor assembly should result in the sensed coolant level exhibiting a linear decrease during the drainage time period (e.g., the sensed coolant level should transition from a steady higher level and then decrease linearly to a steady lower level). If the controller identifies such a linear decrease within the time period, it may determine that the coolant level sensor is operating as expected. On the other hand, if the controller identifies a different sensor signal waveform, such as a lack of such a linear decrease within the time period, the controller may determine that the coolant level sensor is not operating as expected and in a fault mode. The operation of other sensors in the coolant sensor assembly may be assessed similarly, e.g., during drainage each sensor should transition, during the time period, from a first state indicating a given characteristic of the coolant from the coolant being present to a second state indicating a lack of the given characteristic from the coolant being absent.

After drainage and recording/assessing sensor data of the coolant sensor assembly, the controller may be configured to control the drain valve closed and subsequently control the other valves open, to re-fluidly connect the coolant sensor assembly to the coolant tank, etc.

In embodiments, the system may be configured for coolant drained from the coolant sensor assembly to be routed back to the coolant tank, indirectly or directly, e.g., there may be line connected between the drain valve and the coolant system pump, such that the coolant system pump will pump the coolant drained from the coolant sensor assembly into the engine cooling fluid circuit. Or there may be a fluid conduit directly between the drain valve and the tank.

If any failure modes are identified 208, 310, during the system-wide or assembly diagnostic test, the controller 170 generates 210, 312 an instruction or other signal to address the identified failure modes. The instructions may identify the failure mode as well as remedial action to address the failure mode. The controller 170 may cause display of the instructions on a user interface (of the controller or a separate operator device) as directions for an operator to implement the remedial action(s). For example and without limitation, remedial actions include: for a stuck float, remove the sensor package and clean the float; for a non-operational switch, no action needed, or replace the sensor, depending the number of non-operational switches and/or the extent of the sensor malfunction; for power supply issues, inspect sensor package wiring harness; for a damaged float, replace the float and/or entire coolant level sensor; for valve malfunction, inspect and clean or replace the valve, depending on the nature and extent of the malfunction; for a leak, replace the identified leaking component; for an overfilled coolant tank, drain an amount of coolant from the tank; for an underfilled coolant tank, add coolant to the tank. In some embodiments, depending on the nature of the failure mode, the instructions may be delivered in the form of an alert. In some embodiments, the controller 170 may prevent operation of the cooling system 100 until the remedial action is taken.

In embodiments, the controller may be configured, responsive to determination of a fault condition of the cooling system or the coolant sensor assembly, to generate control signals for controlling a device that includes the cooling system (e.g., a vehicle) from a first mode of operation to a different, second mode of operation. E.g., slowing or stopping the vehicle, or preventing or discontinuing the vehicle from embarking on a trip or mission, or operating the engine or engine system in a way that accommodates for low coolant levels or situations where it is unclear what the actual coolant level is (e.g., modes of operation where the engine requires less or minimum cooling). Or operating the cooling system in a way to account for possible low coolant levels, such as running a radiator fan at a higher duty cycle (e.g., for longer and/or more often), and/or routing coolant always through subcoolers, multiple radiators, etc.

The system and methods of the present disclosure provide several advantages over conventional cooling systems and coolant level sensors. In particular, the coolant sensor assembly disclosed herein enables (i) more efficient identification of sensor disfunction (e.g., via visual inspection, while installed or removed, due to the sight glass; or via assembly diagnostic-self test); and (ii) more efficient removal of the assembly from the cooling system for inspection, cleaning, maintenance, repair, or replacement of any component thereof. Additionally, the system-wide diagnostic self-test facilitates (i) more precise and efficient identification and location of failure, including leaks; (ii) ensuring improved function of the cooling system before the vehicle is released for any mission; (iii) reducing or eliminating over/underfill of the coolant tank; (iv) reducing or eliminating the disadvantages of the compression/squeeze tests in conventional cooling systems; (v) reducing or eliminating excessive/insufficient coolant additives; and (vi) ensuring a vehicle is not released for any mission when the vehicle would be unable to complete the mission due to cooling system malfunction. These advantages not only improve the functionality of the cooling system but also facilitate reducing vehicle downtime, both due to more time-consuming and laborious conventional system testing, as well as due to system malfunction.

In one or more embodiments of the present disclosure, a coolant sensor assembly includes a sensor package having a first end and a second end, a first valve coupled between the first end of the sensor package and a coolant tank, a second valve coupled between the second end of the sensor package and the coolant tank, and a third valve coupled in flow communication with the second end of the sensor package. The sensor package includes a partially transparent or semi-transparent sight glass housing a coolant level sensor and configured to receive a flow of coolant therethrough.

Optionally, the coolant level sensor may include a float sensor, capacitive sensor or ultrasound sensor.

Optionally, the sensor package may further includes one or more additional sensors, including one or more of a capacitive sensor, a corrosion sensor, a conductivity sensor, or a pH sensor.

Optionally, the sensor package may further include a secondary tube parallel to and in fluid communication with the sight glass, wherein the one or more additional sensors are arranged in the secondary tube.

Optionally, the one or more additional sensors may be arranged within the sight glass along a coolant flow path therethrough.

Optionally, the sensor package may be removably coupled to the coolant tank.

Optionally, the first valve and the second valve may each include a respective cutout valve that is actuatable between an open position and a closed position.

Optionally, the third valve may be a drain valve actuatable between a closed position and an open, draining position.

Optionally, the coolant level sensor may include float and a stem, the stem including voltage sensor including a plurality of switches oriented along a vertical axis thereof.

Optionally, the assembly may further include a controller communicatively coupled to the coolant sensor and the one or more additional sensors, the controller including a processor and a memory device.

Optionally, the controller may be configured to execute an assembly diagnostic self-test for the coolant sensor assembly.

Optionally, to execute the diagnostic self-test, the controller may be configured to: (a) isolate the sensor package from the coolant tank by actuating the first and second valves from an open position to a closed position and the third valve from a closed position to an open, drain position to drain coolant from the sensor package; (b) record sensor data output from the coolant level sensor and the one or more additional sensors; and (c) analyze the recorded sensor data to identify whether the coolant sensor assembly is experiencing one or more failure modes.

Optionally, to analyze the recorded sensor data, the controller may be further configured to identify a signature sensor output indicative of one or more of: one or more missing switches, a stuck float of the coolant level sensor, one or more open switches, one or more switch failures, a sunk float of the coolant level sensor, a clog in the sensor package, or coolant contamination.

Optionally, the controller may be further configured to, when the diagnostic self-test indicates the coolant sensor assembly is experiencing one or more failure modes: (a) identify a nature of the one or more failure modes experienced by the coolant sensor assembly; (b) generate an instruction for remedial action to address the one or more failure modes experienced by the coolant sensor assembly; and (c) cause display of the instruction for remedial action on a local or remote user interface.

In one or more embodiments of the present disclosure, a cooling system of a vehicle includes a coolant tank, a coolant sensor assembly in flow communication with the coolant tank, and a controller configured to execute a diagnostic self-test of the cooling system by: (a) cycling the cooling system through a plurality of operating modes; and (b) in each operating mode of the plurality of operating modes: (i) recording sensor data output from the coolant sensor assembly to detect a level of coolant in the coolant tank; (ii) isolating the coolant sensor assembly from the coolant tank; (iii) recording sensor data output from the coolant sensor assembly as the coolant is drained from the coolant sensor assembly and the one or more additional sensors; and (iv) analyzing the recorded sensor data to identify whether the cooling system and/or the coolant sensor assembly is experiencing one or more failure modes.

Optionally, the controller may be further configured to: (c) retrieve historical sensor data from a memory; (d) analyze the recorded sensor data and the historical sensor data to determine a rate of coolant loss during any one or more operating modes of the plurality of operating modes; and (e) based on the rate of coolant loss, identify one or more sources of the coolant loss.

Optionally, the controller may be further configured to analyze the recorded sensor data to determine whether the coolant tank is overfilled or underfilled.

Optionally, the controller may be further configured to: (f) generate an instruction for remedial action to address a cause of the one or more failure modes; and (g) transmit the instruction for remedial action as an alert to a local or remote user interface.

In one or more embodiments of the present disclosure, a method of diagnosing a cooling system of a vehicle includes (a) recording, by a controller, sensor data output from a coolant sensor assembly in flow communication with a coolant tank of the cooling system, to detect a level of coolant in the coolant tank; (b) isolating the coolant sensor assembly from the coolant tank; (c) recording, by the controller, sensor data output from the coolant sensor assembly as the coolant is drained from the coolant sensor assembly; and (d) analyzing, by the controller, the recorded sensor data to identify whether the cooling system and/or the cooling sensor assembly is experiencing one or more failure modes.

Optionally, the method may include cycling the cooling system through a plurality of operating modes; and performing steps (a)-(d) in each operating mode of the plurality of operating modes.

As used herein, the terms "processor" and "computer," and related terms, e.g., "processing device," "computing device," and "controller" may be not limited to just those integrated circuits referred to in the art as a computer, but refer to a microcontroller, a microcomputer, a programmable logic controller (PLC), field programmable gate array, and application specific integrated circuit, and other programmable circuits. Suitable memory may include, for example, a computer-readable medium. A computer-readable medium may be, for example, a random-access memory (RAM), a computer-readable non-volatile medium, such as a flash memory. The term "non-transitory computer-readable media" represents a tangible computer-based device implemented for short-term and long-term storage of information, such as, computer-readable instructions, data structures, program modules and sub-modules, or other data in any device. Therefore, the methods described herein may be encoded as executable instructions embodied in a tangible, non-transitory, computer-readable medium, including, without limitation, a storage device and/or a memory device. Such instructions, when executed by a processor, cause the processor to perform at least a portion of the methods described herein. As such, the term includes tangible, computer-readable media, including, without limitation, non-transitory computer storage devices, including without limitation, volatile and non-volatile media, and removable and non-removable media such as firmware, physical and virtual storage, CD-ROMS, DVDs, and other digital sources, such as a network or the Internet.

The singular forms "a", "an", and "the" include plural references unless the context clearly dictates otherwise. "Optional" or "optionally" means that the subsequently described event or circumstance may or may not occur, and that the description may include instances where the event occurs and instances where it does not. Approximating language, as used herein throughout the specification and claims, may be applied to modify any quantitative representation that could permissibly vary without resulting in a change in the basic function to which it may be related. Accordingly, a value modified by a term or terms, such as "about," "substantially," and "approximately," may be not to be limited to the precise value specified. In at least some instances, the approximating language may correspond to the precision of an instrument for measuring the value. Here and throughout the specification and claims, range limitations may be combined and/or interchanged, such ranges may be identified and include all the sub-ranges contained therein unless context or language indicates otherwise.

This written description uses examples to disclose the embodiments, including the best mode, and to enable a person of ordinary skill in the art to practice the embodiments, including making and using any devices or systems and performing any incorporated methods.

We claim:

1. A coolant sensor assembly comprising:

a sensor package having a first end and a second end, the sensor package comprising a partially transparent or semi-transparent sight glass housing a coolant level sensor and configured to receive a flow of coolant therethrough;

a first valve coupled between the first end of the sensor package and a coolant tank;

a second valve coupled between the second end of the sensor package and the coolant tank; and a third valve coupled in flow communication with the second end of the sensor package, wherein the sensor package further comprises one or more additional sensors, including one or more of a capacitive sensor, a corrosion sensor, a conductivity sensor, or a pH sensor, and wherein the sensor package further comprises a secondary tube parallel to and in fluid communication with the sight glass, and wherein at least one of the one or more additional sensors is arranged in either the secondary tube or made integral with the sight glass.

2. The coolant sensor assembly of claim 1, wherein the coolant level sensor comprises one or more of: a float sensor, a capacitive sensor, or an ultrasound sensor.

3. The coolant sensor assembly of claim 1, wherein the sensor package further comprises a secondary tube parallel to and in fluid communication with the sight glass, wherein at least one of the one or more additional sensors is arranged in the secondary tube.

4. The coolant sensor assembly of claim 1, wherein at least one of the one or more additional sensors is arranged within the sight glass along a coolant flow path therethrough.

5. The coolant sensor assembly of claim 1, wherein the sensor package is removably coupled to the coolant tank.

6. The coolant sensor assembly of claim 1, wherein the first valve and the second valve each comprises a respective cutout valve that is actuatable between an open position and a closed position.

7. The coolant sensor assembly of claim 1, wherein the third valve is a drain valve actuatable between a closed position and an open, draining position.

8. The coolant sensor assembly of claim 1, wherein the coolant level sensor comprises a float and a stem, the stem including an electrical sensor comprising a plurality of switches oriented along a vertical axis thereof.

9. A coolant sensor assembly comprising:

a sensor package having a first end and a second end, the sensor package comprising a partially transparent or semi-transparent sight glass housing a coolant level sensor and configured to receive a flow of coolant therethrough;

a first valve coupled between the first end of the sensor package and a coolant tank;

a second valve coupled between the second end of the sensor package and the coolant tank;

a third valve coupled in flow communication with the second end of the sensor package; and a controller communicatively coupled to the coolant sensor, and, if present, one or more additional sensors, the controller comprising one or more processors and a memory device, wherein to execute a diagnostic test for the coolant sensor assembly, the controller is configured to:

isolate the sensor package from the coolant tank by actuating the first and second valves from an open position to a closed position;

actuate the third valve from a closed position to an open, drain position to drain coolant from the sensor package;

record sensor data output from the coolant level sensor; and analyze the recorded sensor data to determine whether the coolant sensor assembly is experiencing one or more failure modes.

10. The coolant sensor assembly of claim 9, wherein the sensor package further comprises one or more additional sensors, the controller communicatively coupled to the one or more additional sensors.

11. The coolant sensor assembly of claim 9, wherein to analyze the recorded sensor data, the controller is further configured to identify a signature sensor output indicative of one or more of: one or more missing switches, a stuck float of the coolant level sensor, one or more open switches, one or more switch failures, a sunk float of the coolant level sensor, a clog in the sensor package, or coolant contamination.

12. The coolant sensor assembly of any of claim 9, wherein the controller is further configured to, responsive to when the diagnostic test indicates the coolant sensor assembly is experiencing one or more failure modes:

identify the one or more failure modes experienced by the coolant sensor assembly; and one or more of:

generate an instruction for remedial action to address the one or more failure modes experienced by the coolant sensor assembly, and cause display of the instruction for remedial action on a local or remote user interface; or based on the one or more failure modes that are identified, generate one or more signals to automatically control a device that includes the coolant tank and the coolant sensor assembly from a first mode of operation to a different, second mode of operation.

13. A system of a vehicle, the system comprising:

a cooling system of a vehicle, the cooling system including a coolant tank;

a coolant sensor assembly in flow communication with the coolant tank; and a controller configured to execute a diagnostic test of the cooling system by:

cycling the cooling system through a plurality of operating modes; and in each operating mode of the plurality of operating modes:

recording first sensor data output from the coolant sensor assembly to detect a level of coolant in the coolant tank;

isolating the coolant sensor assembly from the coolant tank;

recording second sensor data output from the coolant sensor assembly as the coolant is drained from the coolant sensor assembly; and analyzing the recorded first and second sensor data to determine whether the cooling system is experiencing one or more failure modes, and wherein the controller is further configured to:

retrieve historical sensor data from a memory;

analyze the recorded first and second sensor data and the historical sensor data to determine a rate of coolant loss during any one or more operating modes of the plurality of operating modes; and based on the rate of coolant loss, identify one or more sources of the coolant loss.

14. The system of claim 13, wherein the controller is further configured to analyze the recorded first and second sensor data to determine whether the coolant tank is overfilled or underfilled.

15. The system of claim 13, wherein the controller is further configured to at least one of:

generate an instruction for remedial action to address a cause of the one or more failure modes, and transmit the instruction for remedial action as an alert to a local or remote user interface; or based on the one or more failure modes that are determined, generate one or more signals to automatically control the vehicle from a first mode of operation to a different, second mode of operation.

16. A method of diagnosing a cooling system of a vehicle, the method comprising:

(a) recording, by a controller, first sensor data output from a coolant sensor assembly in flow communication with a coolant tank of the cooling system, to detect a level of coolant in the coolant tank;

(b) isolating the coolant sensor assembly from the coolant tank;

(c) recording, by the controller, second sensor data output from the coolant sensor assembly as the coolant is drained from the coolant sensor assembly; and (d) analyzing, by the controller, the recorded first, the second sensor data, and historical sensor data to determine whether the cooling system is experiencing one or more failure modes.

17. The method of claim 16, further comprising:

cycling the cooling system through a plurality of operating modes; and performing steps (a)-(d) in each operating mode of the plurality of operating modes.

18. The method of claim 16, wherein the one or more failure modes comprises a coolant loss.

19. The method of claim 18, further comprising:

identifying a source of the coolant loss.

* * * * *